US006054661A

United States Patent [19]

Castonguay et al.

[11] Patent Number: 6,054,661

[45] **Date of Patent: *Apr. 25, 2000**

[54] CIRCUIT BREAKER BELL ALARM ACCESSORY WITH LOCKOUT FUNCTION

[75] Inventors: Roger N. Castonguay, Terryville; Dean A. Robarge, Southington, both of Conn.

[73] Assignee: General Electric Company, Schenectady, N.Y.

[ * ] Notice: This patent is subject to a terminal disclaimer.

[21] Appl. No.: 09/006,789

[22] Filed: Jan. 14, 1998

[51] Int. Cl.[7] ..... H01H 9/24

[52] U.S. Cl. ..... 200/308; 200/50.01; 200/325

[58] Field of Search ..... 200/308, 50.01, 200/322, 324, 325; 340/638, 644; 335/17

[56] References Cited

U.S. PATENT DOCUMENTS

| | | | |
|---|---|---|---|
| 3,084,238 | 4/1963 | Baskerville . | |
| 3,095,489 | 6/1963 | Baird . | |
| 4,672,501 | 6/1987 | Bilac et al. | 361/96 |
| 5,502,286 | 3/1996 | Pollman et al. | 200/401 |

*Primary Examiner*—Renee S. Luebke
*Attorney, Agent, or Firm*—Cantor Colburn LLP; Damian G. Wasserbauer; Carl B. Horton

[57] ABSTRACT

An air circuit breaker bell alarm lock-out accessory interacts with the circuit breaker closing system to prevent charging of the circuit breaker closing spring until and unless the bell alarm module has been manually reset. A lockout slide on the bell alarm module support interacts with the circuit breaker closing spring operating link to prevent the recharging of the closing spring.

15 Claims, 5 Drawing Sheets

CIRCUIT BREAKER BELL ALARM ACCESSORY WITH LOCKOUT FUNCTION

BACKGROUND OF THE INVENTION

Air circuit breakers as described within U.S. Pat No. 3,095,489 entitled "Manual Charging Means for Stored Energy Closing Mechanisms of Electric Circuit Breakers" and U.S. Pat. No. 3,084,238 entitled "Ratchet Mechanism for Charging a Closing Spring in an Electric Circuit Breaker" include operating mechanisms that are mainly exposed to the environment. Since the air circuit breakers are rated to carry up to several thousand amperes of current continuously, the exposure to convection cooling air assists in keeping the operating components within reasonable temperature limits.

Various accessory devices are used with such air circuit breakers to provide auxiliary function along with overcurrent protection. One such accessory is the bell alarm accessory that provides local and remote indication as to the occurrence of circuit interruption. U.S. Pat. No. 5,502,289 entitled "Bell Alarm and Lock-Out for High Ampere-Rated Circuit Breakers" describes a bell alarm accessory used with so-called "insulated case" circuit breakers wherein the circuit breaker interrupting components are completely enclosed within an insulating plastic enclosure.

U.S. patent application Ser. No. 08/875,595 filed on Jun. 19, 1997 entitled "Circuit Breaker Bell Alarm Accessory with Lockout" describes a bell alarm accessory for use with a high ampere-rated air circuit breaker that provides local as well as remote indication of such circuit interruption as well as preventing circuit breaker contact closure until and unless the bell alarm accessory has been manually reset.

High-ampere rated air type circuit breakers operate in the range of 2500 to 5000 amperes such that the large circuit breaker operating components are arranged with the bell alarm reset components in a particular manner. When low ampere-rated air type circuit breakers, that operate in the range of 150 to 1500 amperes, require bell alarms with lockout function to prevent contact closure until the bell alarm unit is reset, the arrangement of the circuit breaker smaller operating components do not allow the use of the high ampere-rated bell alarm reset accessory.

One purpose of the invention accordingly, is to describe a bell alarm accessory reset unit for use with low ampere-rated air type circuit breakers that prevents the circuit breaker contacts from becoming closed until the bell alarm module has become manually reset.

SUMMARY OF THE INVENTION

An air circuit bell alarm lock-out accessory interacts with the circuit breaker closing system to prevent charging of the circuit breaker closing spring until and unless the bell alarm module has been manually reset. A lockout slide on the bell alarm module support interacts with the circuit breaker closing spring operating link to prevent the recharging of the closing spring. The bell alarm module reset plunger on the bottom of the module extends through an aperture in the lockout slide to prevent return of the lockout slide until the module is manually reset to remove the reset plunger from the aperture.

DESCRIPTION OF THE PREFERRED EMBODIMENT

Figure 1:
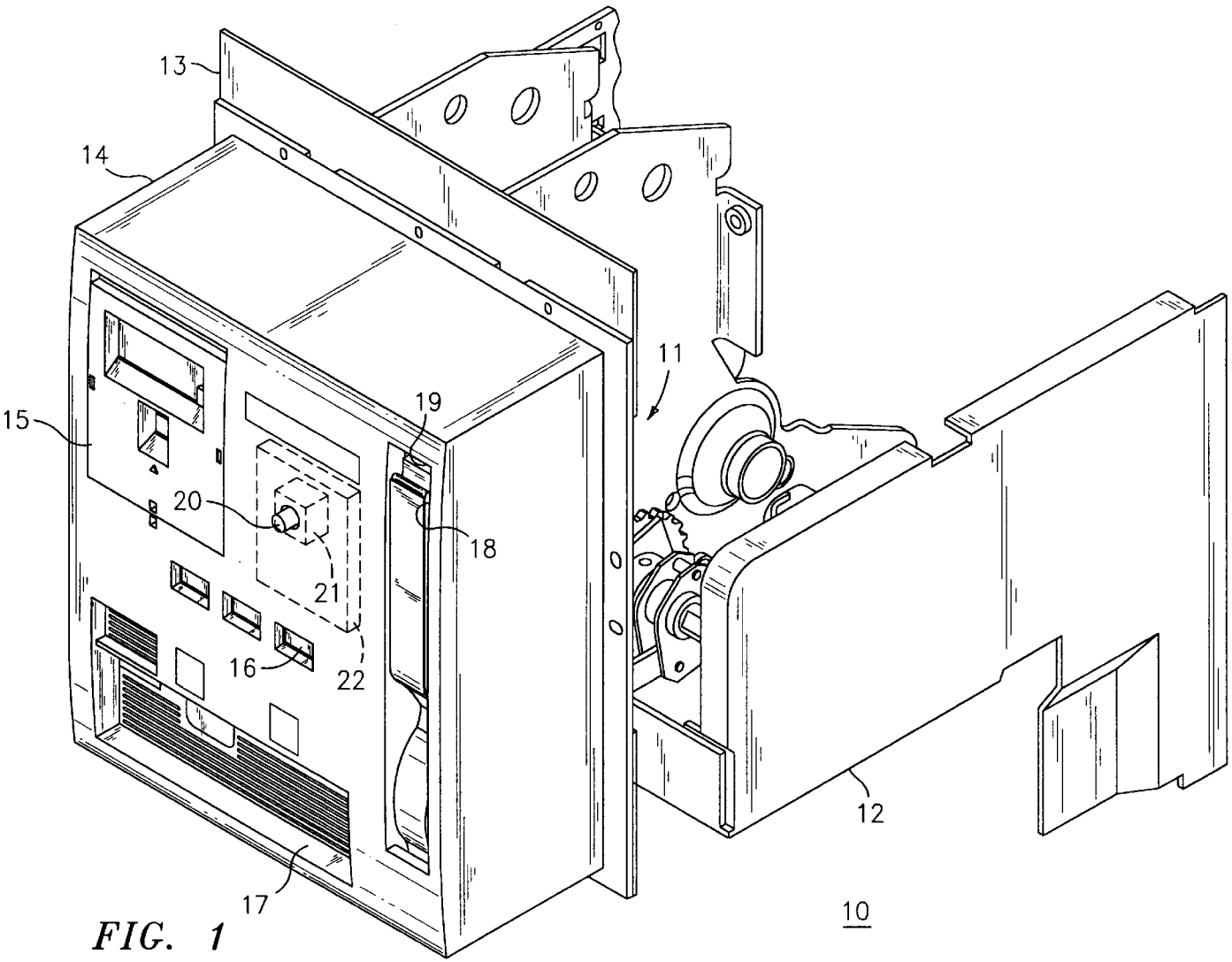
FIG. 1 is top perspective view of an air circuit breaker containing the bell alarm lock-out accessory unit attached to a front part of the circuit breaker contact closing assembly in accordance with the invention.

The air circuit breaker 10 of FIG. 1 is shown attached to the circuit breaker cover plate 13 interfacing with the circuit breaker contact closing assembly 11 that is positioned between the circuit breaker operating mechanism sideframes 12 similar to that described within the aforementioned U.S. Pat. No. 3,095,489. The circuit breaker cover 14 supports the trip unit programmer 15 which programmer is similar to that described in U.S. Pat. No. 4,672,501 entitled "Circuit Breaker and Protective Relay Unit". The circuit breaker cover includes buttons 16 for releasing the circuit breaker contacts (not shown) to their OPEN condition and for moving the contacts to their CLOSED condition. The circuit breaker operating handle 18, positioned within the handle recess 19, allows manual interaction with the contact springs closing mechanism 11 to both open and close the circuit breaker contacts. An accessory such as a bell alarm module 21, similar to that described in the aforementioned U.S. Pat. No. 5,502,286 is mounted on a bell alarm lock-out unit 22 to provide visual indication of the occurrence of contact separation by means of the pop-up target 20. Other circuit breaker accessories can be inserted within the accessory recess 17, if so desired.

Figure 2:
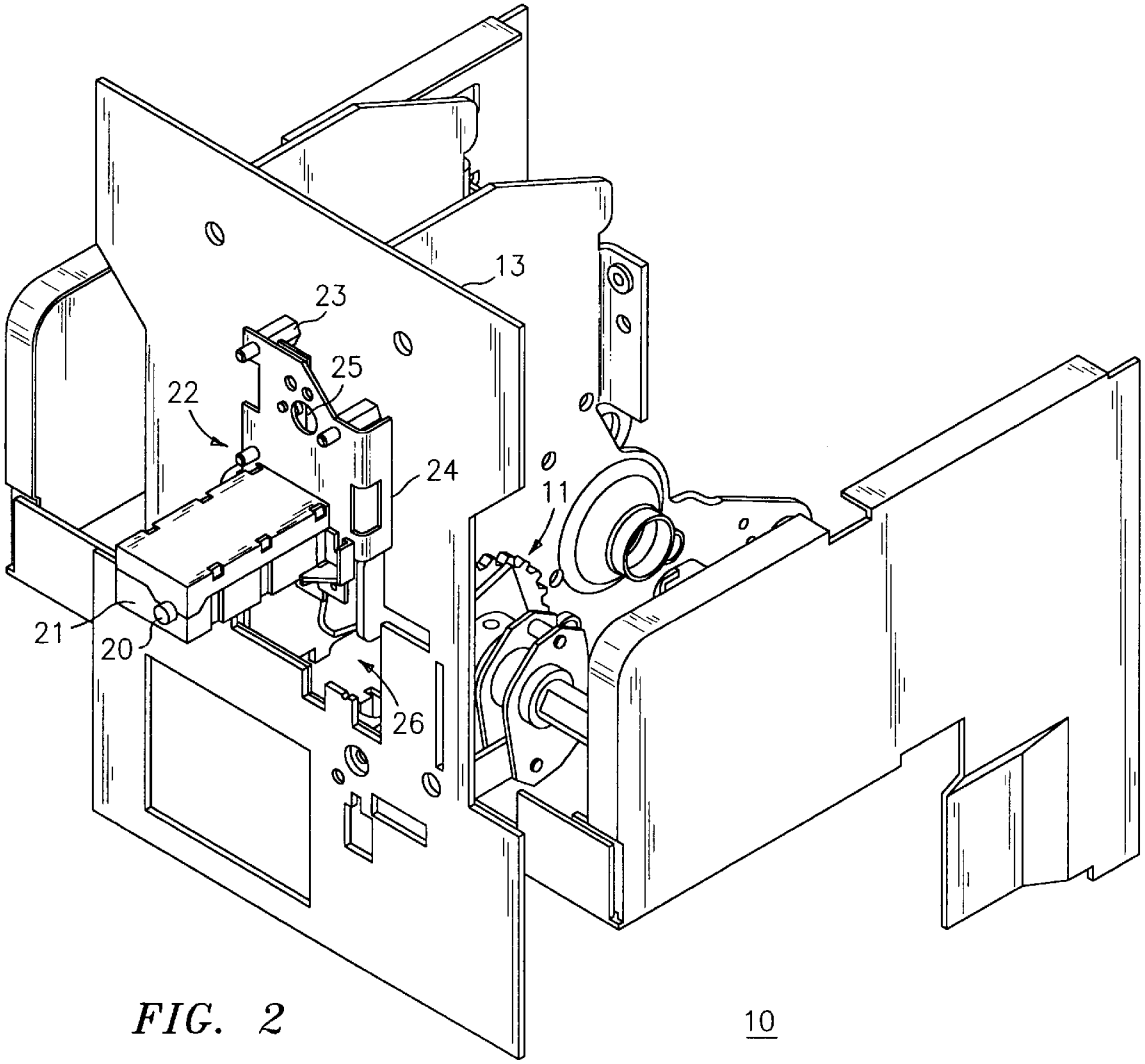
FIG. 2 is a top perspective view of the air circuit breaker of FIG. 1 with the circuit breaker cover removed to depict the bell alarm lock-out accessory unit.

The circuit breaker 10 is depicted in FIG. 2 with the circuit breaker cover removed from the circuit breaker cover plate 13 to illustrate the position of the bell alarm module 21 on the bell alarm lock-out unit 22 which is arranged on the bell alarm support plate 24 over a rectangular aperture 26 formed in the cover plate 13. In the contact CLOSED condition, the bell alarm target 20 is unextended from the bell alarm module 21 and becomes extended therefrom upon occurrence of contact separation during circuit overload conditions. The bell alarm support plate 24 is fastened to the cover plate 13 by means of mounting studs 23 and the reset slide 25 is attached to the bottom of the support plate 24 for interaction with the contact springs closing mechanism 11 in the manner to be described below.

Figure 3:
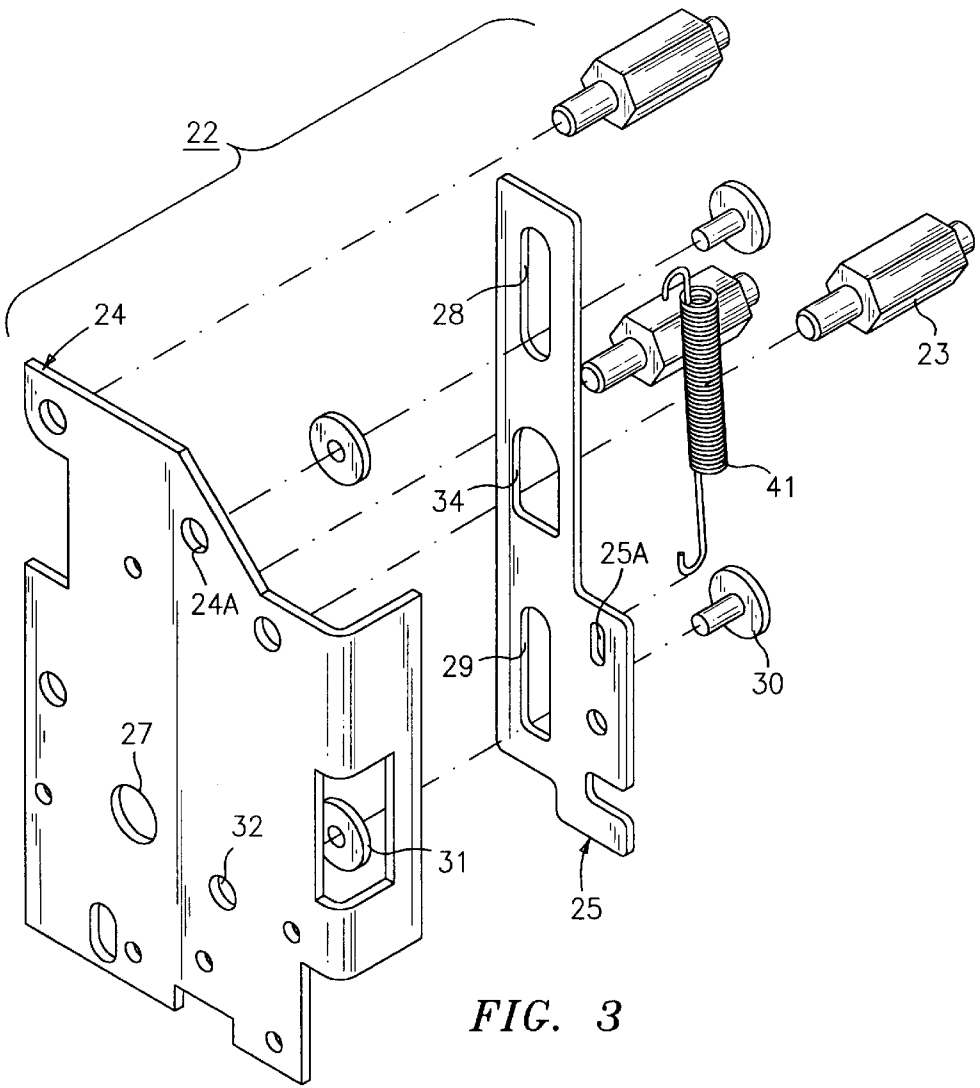
FIG. 3 is an exploded and enlarged top perspective view of the components contained within the bell alarm lock-out accessory unit of FIGS. 1 and 2 prior to attachment to the circuit breaker.

The bell alarm lock-out unit 22 is depicted now in FIG. 3 prior to assembly of the bell alarm lock-out unit components. The bell alarm lock-out unit support plate 24 and reset slide 25 are similar to those described in the U.S. patent application entitled "Circuit Breaker Bell Alarm Accessory with Automatic Reset" to be filed concurrently by General Electric, Electrical Distribution & Control, U.S. patent application Ser. No. 09/006,788, and the reset slide is attached to the underside of the support plate by means of rivets 30, bushings 31 and apertures 32, as indicated. A pair of elongated slots 28, 29 allow the reset slide to move along the underside of the support plate and a return spring 41 attaches there between by means of the apertures 24A, 25A to bias the reset slide to a home position whereby the first bell alarm plunger aperture 27 on the support plate aligns with a second bell alarm plunger aperture 34 on the reset slide 25. When the bell alarm lock-out unit 22 is completely assembled, it is secured to the circuit breaker cover support plate 13, shown earlier, by means of threaded studs 23.

Figure 4:
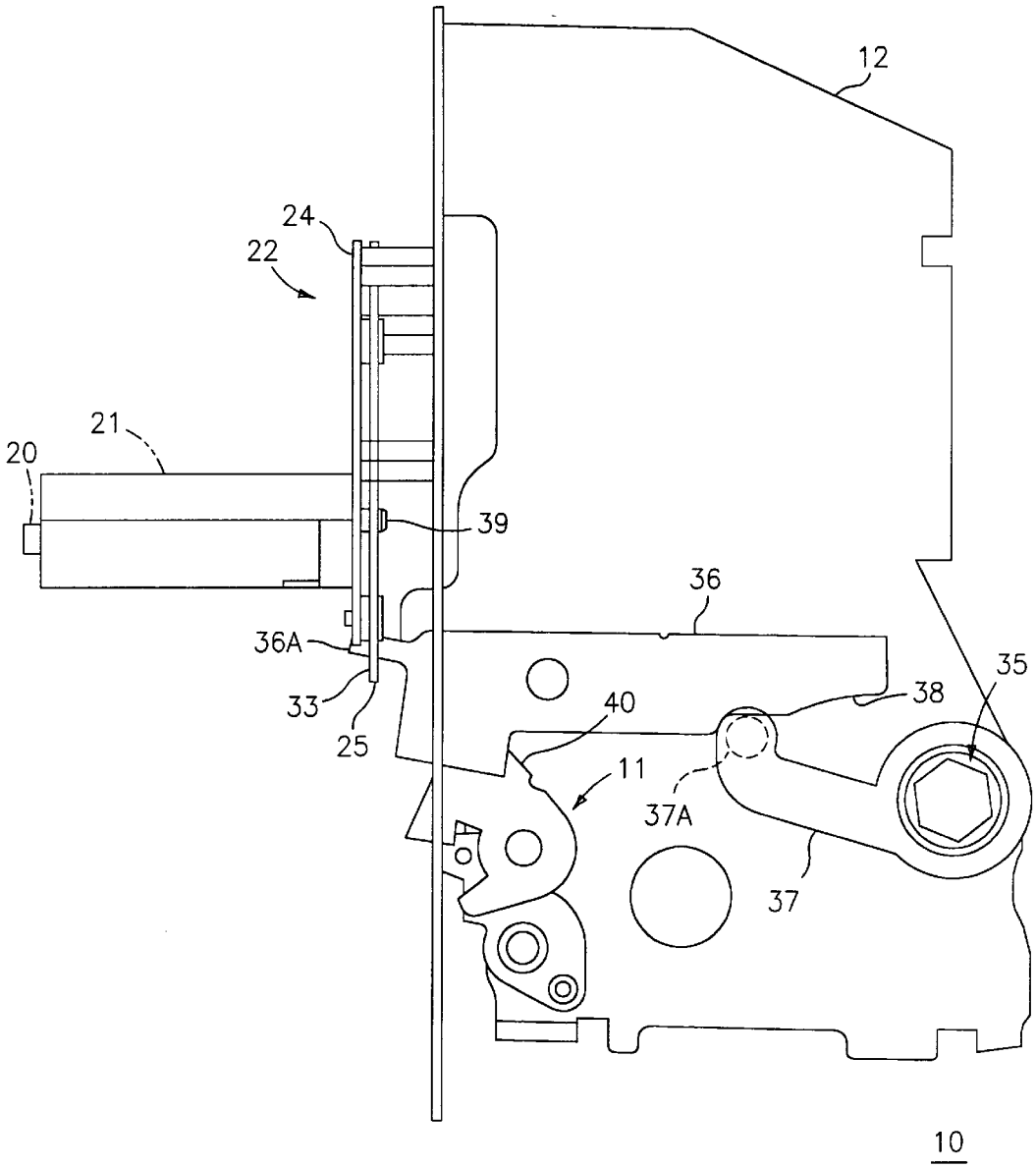
FIG. 4 is an enlarged side view of the bell alarm lock-out accessory unit of FIG. 3 with the circuit breaker closing spring in a charged condition.

The circuit breaker 10 is shown in FIG. 4 with the closing mechanism 11 attached to the side frame 12 partially exposed to depict the closing shaft 35 in a charged condition and with the pop-up target 20 on top of the bell alarm module in its unextended home position. The lift lever 37 extending from the closing shaft contacts the operating link 36 by means of the post 37A in contact with the cam surface 38 formed on the operating link. The bell crank 40 within the closing mechanism is in the closing spring charged condition and the tab 36A on the end of the closing system operating link 36 is captured within the drive slot 33 formed at the end of the reset slide 25. The bell alarm plunger 39 on the bottom of the bell alarm module 21 is in its extended home position relative to the reset slide 25 under the support plate 24 of the bell alarm lockout unit 22.

Figure 5:
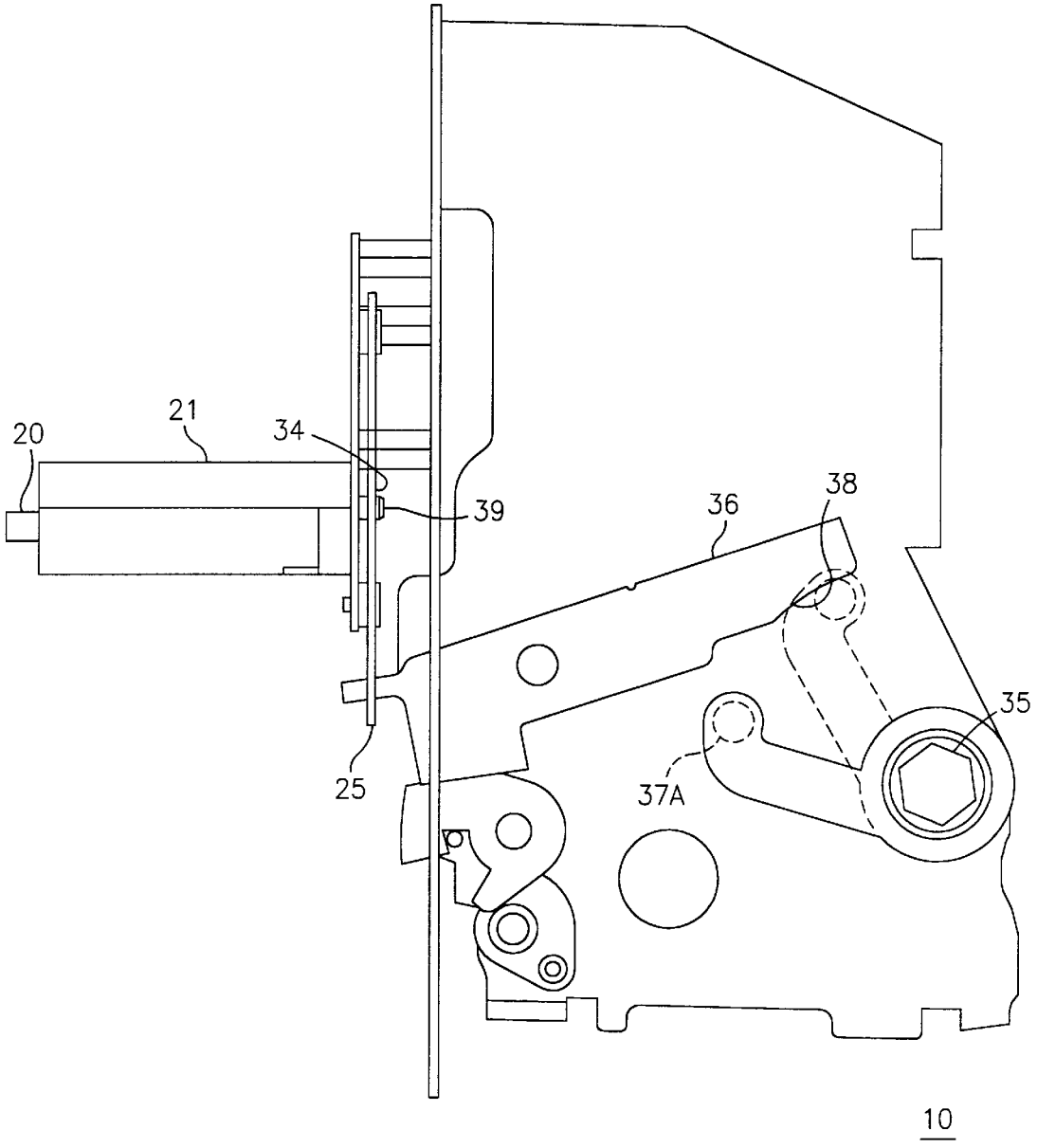
FIG. 5 is an enlarged side view of the bell alarm lock-out accessory unit of FIG. 3 with the circuit breaker closing spring in an uncharged condition.

The circuit breaker 10 is shown in FIG. 5 in the TRIPPED condition of the circuit breaker contacts such that the pop-up target 20 on the top of the bell alarm module 21 is extended to provide visual target indication thereof and the bell alarm plunger 39 on the bottom of the bell alarm module has become extended through the bell alarm second aperture 34 shown in FIG. 2 formed in the reset slide 25. The closing shaft 35 has rotated in the clockwise direction from that position indicated in solid lines to that indicated in phantom with the post 37A in contact with the cam surface 38 formed on the underside of the operating link 36. When an attempt is made to rotate the closing shaft 35 to charge the circuit breaker closing spring, the interference presented by the bell alarm plunger 39 within the bell alarm second aperture 34 prevents the rotation of the closing shaft until the bell alarm module 21 is manually reset by manually depressing the pop-up target 20 back to the home position shown in FIG. 4 whereby the bell alarm plunger 39 retracts from within the bell alarm second aperture to allow rotation of the operating link 36 and away from the cam surface 38 and return the closing shaft 35 to the charged position.

It is claimed:

1. A bell alarm lock-out unit comprising:

a support platform supporting a circuit breaker bell alarm accessory, said support platform including a plate having a first bell alarm aperture arranged for receiving a bell alarm plunger on a bottom of said bell alarm accessory; and a reset slide slidably mounted to a bottom of said support platform, said reset slide including a reset slide second aperture receiving said bell alarm accessory plunger when a closing spring associated with a circuit breaker has become discharged, and said reset slide further includes a pair of elongated slots formed within said reset slide and said support platform includes a pair of rivets extending within said slots to provide movement of said reset slide relative to said support platform.

2. The bell alarm lock-out unit of claim 1 further including a drive slot formed on one end of said reset slide, said drive slot being arranged for receiving a tab formed at one end of a circuit breaker closing spring operating link.

3. The bell alarm lock-out unit of claim 2 whereby depression of a pop-up target causes said bell alarm accessory plunger to retract from within said reset slide second aperture to allow rotation of said circuit breaker closing spring operating link for charging a circuit breaker contact closing spring.

4. The bell alarm lock-out unit of claim 1 wherein said support platform is adapted for attaching to a circuit breaker operating mechanism enclosure.

5. The bell alarm lock-out unit of claim 4 wherein said support platform is attached to a circuit breaker operating mechanism enclosure by means of stand-off connectors.

6. The bell alarm lock-out unit of claim 1 further including a return spring connecting between said support platform and said reset slide, said return spring biasing said reset slide to a home position on said support platform.

7. A bell alarm lock-out unit comprising:

a support platform supporting a circuit breaker bell alarm accessory, said support platform including a plate having a first bell alarm aperture arranged for receiving a bell alarm plunger on a bottom of said bell alarm accessory;

a reset slide slidably mounted to a bottom of said support platform, said reset slide including a reset slide second aperture receiving said bell alarm accessory plunger when a closing spring associated with a circuit breaker has become discharged; and a return spring connecting between said support platform and said reset slide, said return spring biasing said reset slide to a home position on said support platform.

8. The bell alarm lock-out unit of claim 7 further including a drive slot formed on one end of said rest slide, said drive slot being arranged for receiving a tab formed at one end of a circuit breaker closing spring operating link.

9. The bell alarm lock-out unit of claim 8 whereby depression of a pop-up target causes said bell alarm accessory plunger to retract from within said reset slide second aperture to allow rotation of said circuit breaker closing spring operating link for charging a circuit breaker contact closing spring.

10. The bell alarm lock-out unit claim 7 wherein said support platform is adapted for attaching to a circuit breaker operating mechanism enclosure.

11. The bell alarm lock-out unit of claim 10 wherein said support platform is attached to a circuit breaker operating mechanism enclosure by means of stand-off connectors.

12. A circuit breaker comprising:

an enclosure;

a bell alarm accessory on said enclosure, said bell alarm accessory having a pop-up target on a top thereof for indicating occurrence of a tripped condition within said circuit breaker enclosure and a bell alarm plunger on a bottom thereof for interacting with a bell alarm lock-out unit, said bell alarm lock-out comprising, in combination, a support platform supporting said bell alarm accessory, said support platform including a plate having a first aperture arranged for receiving said bell alarm plunger; and a reset slide slidably mounted to a bottom of said support platform, said reset slide including a reset slide second aperture receiving said bell alarm plunger when a closing spring within said circuit breaker has become discharged, and a pair of elongated slots formed within said reset slide and said support platform includes a pair of rivets extending within said slots to provide a movement of said reset slide relative to said support platform.

13. The circuit breaker of claim 12 further including a drive slot formed on one end of said reset slide, the drive slot being arranged for receiving a tab formed at one end of a circuit breaker closing spring operating link.

14. The circuit breaker of claim 12 whereby a depression of said pop-up target causes said bell alarm accessory plunger to retract from within said reset slide second aperture to allow rotation of a circuit breaker closing spring operating link for charging a circuit breaker contact closing spring.

15. The circuit breaker of claim 12 wherein said support platform is attached to said top part of said enclosure.

* * * * *